US006616232B2

(12) United States Patent
Herman et al.

(10) Patent No.: US 6,616,232 B2
(45) Date of Patent: Sep. 9, 2003

(54) TILTABLE SPRING-BIASED CHAIR

(75) Inventors: Harold B. Herman, Williamsville, NY (US); Mark G. Hogg, Buffalo, NY (US); Dennis A. Kwaczala, West Seneca, NY (US)

(73) Assignee: HMS Seating Inc., Buffalo, NY (US)

( * ) Notice: Subject to any disclaimer, the term of this patent is extended or adjusted under 35 U.S.C. 154(b) by 0 days.

(21) Appl. No.: 09/879,345

(22) Filed: Jun. 12, 2001

(65) Prior Publication Data

US 2002/0185899 A1 Dec. 12, 2002

(51) Int. Cl.[7] ..... A47C 1/02
(52) U.S. Cl. ..... 297/325; 297/289; 297/68
(58) Field of Search ..... 297/327, 328, 297/344.1, 325, 285, 377, 289, 296, 297, 298, 68, 423.29, 423.28, 423.26; 292/225, 217, 214

(56) References Cited

U.S. PATENT DOCUMENTS

| | | | | |
|---|---|---|---|---|
| 1,545,269 A | * | 7/1925 | Munroe | 297/328 |
| 1,629,630 A | | 5/1927 | Miller | |
| 1,877,769 A | * | 9/1932 | Knapp | 294/344.1 |
| 2,152,024 A | | 3/1939 | Brosset | |
| 2,562,041 A | | 7/1951 | Keller et al. | |
| 2,570,000 A | | 10/1951 | Lowry | |
| 2,690,786 A | | 10/1954 | Sedlock | |
| 4,729,573 A | * | 3/1988 | Davis | 280/304.1 |
| 4,945,582 A | * | 8/1990 | Hayton et al. | 297/423.26 |
| 4,974,905 A | * | 12/1990 | Davis | 297/377 |
| 5,100,200 A | * | 3/1992 | Keusch et al. | 297/296 |
| 5,360,255 A | * | 11/1994 | Cook et al. | 297/232 |
| 5,362,128 A | * | 11/1994 | Wildern, IV | 297/284.11 |
| 5,779,316 A | * | 7/1998 | Sugawa et al. | 297/423.26 |
| 5,961,183 A | * | 10/1999 | Smith et al. | 248/429 |
| 6,145,913 A | * | 11/2000 | Odagaki | 296/65.03 |
| 6,161,890 A | * | 12/2000 | Pesta et al. | 248/503.1 |
| 6,345,856 B1 | * | 2/2002 | Minai | 296/65.03 |

FOREIGN PATENT DOCUMENTS

DE 3311376 A1 * 10/1984 ..... A61G/5/00

* cited by examiner

*Primary Examiner*—Peter M. Cuomo
*Assistant Examiner*—Stephanie Harris
(74) *Attorney, Agent, or Firm*—Joseph P. Gastel

(57) ABSTRACT

A chair including a frame, a seat pivotally mounted on the frame, a spring construction effectively positioned between the seat and the frame, a first selectively actuatable latch positioned between the seat and the frame effective to maintain the seat latched in a less inclined position on the frame, a second selectively actuatable latch positioned between the seat and the frame effective to maintain the seat latched in a more inclined position on the frame against the bias of the spring construction, a foot rest pivotally mounted on the frame and movable between retracted and extended positions, and a cable secured to the foot rest for selectively retracting the foot rest to the retracted position.

16 Claims, 10 Drawing Sheets

FIG. 7

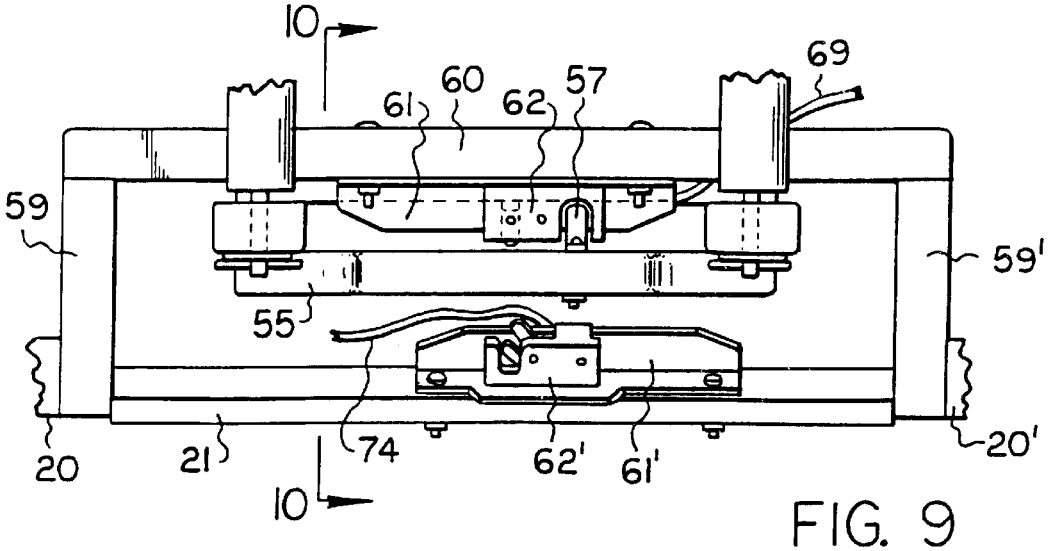
FIG. 9
FIG. 10
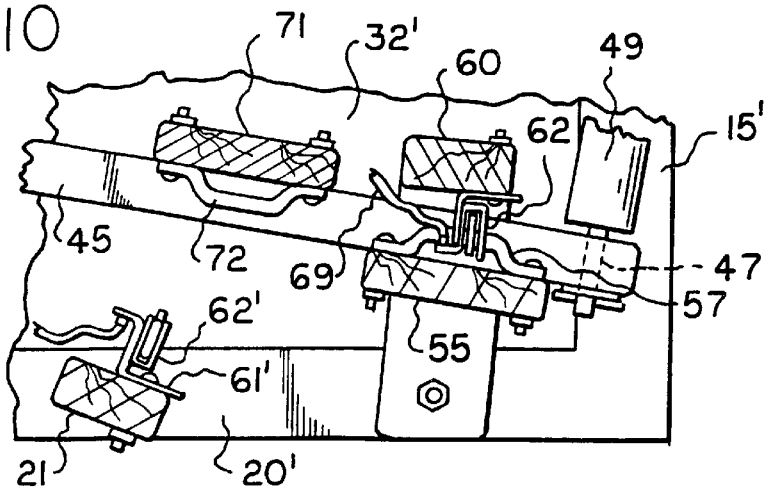
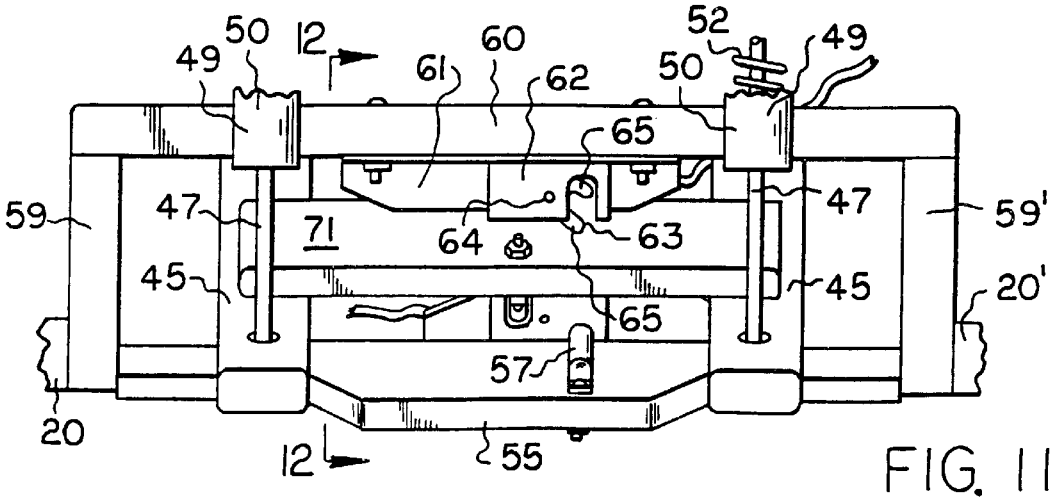
FIG. 11

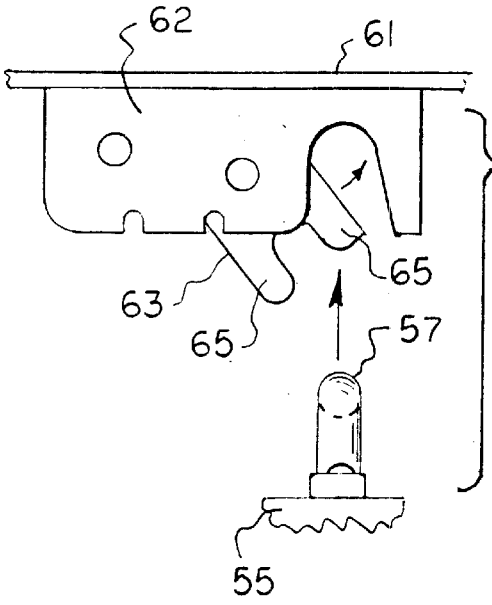
FIG. 11A
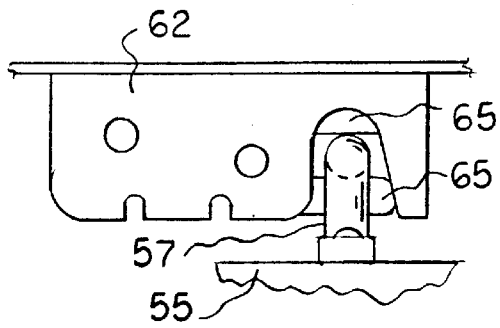
FIG. 11B
FIG. 16
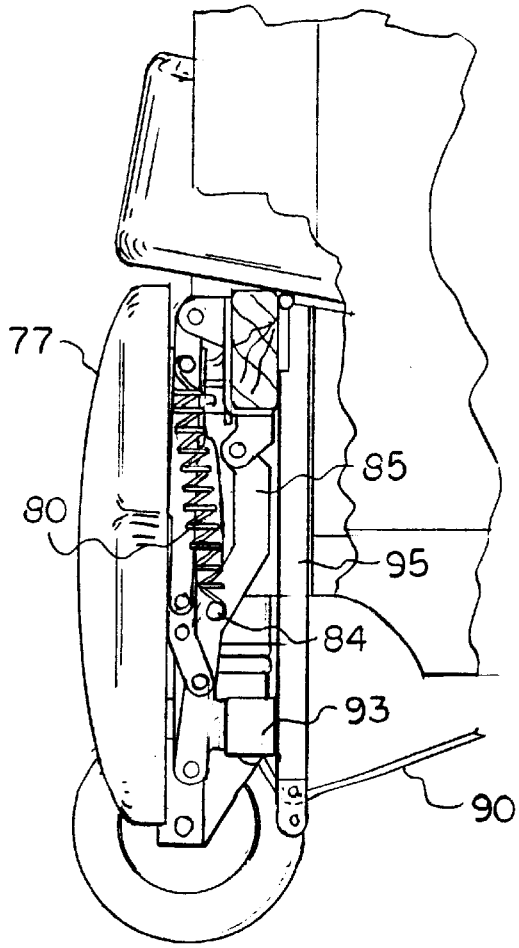

TILTABLE SPRING-BIASED CHAIR

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

The present invention relates to a chair which is primarily designed for use by nursing home patients who can enter and leave the chair in a normal manner and who also will be retained in the chair in a seated position without restraints.

Insofar as known, in the past nursing home patients were restrained in chairs by means of various types of tying arrangements. This was found unsatisfactory for a number of reasons which included the necessity to tie and untie the patient, and, in addition, the patient could sometimes be tangled in the ties and be injured. It is with overcoming the foregoing deficiencies of the prior art that the present chair is concerned.

BRIEF SUMMARY OF THE INVENTION

It is one object of the present invention to provide a chair which is to be used in facilities such as hospitals and nursing homes wherein the patient can enter and leave the chair when the seat and back are latched in a less inclined position and after the patient has been seated, the seat and back can be unlatched from the latched position whereby the center of gravity of the patient will cause the seat and back to pivot to a more inclined position against the bias of springs and then be automatically latched in the more inclined position from which a patient cannot leave the chair, notwithstanding that he is not restrained by ties.

Another object of the present invention is to provide a chair as described in the immediately preceding paragraph which is mounted on wheels and the back portion of the chair frame is constructed so that an attendant can push the chair, as is required, to various locations with the patient therein.

A further object of the present invention is to provide a chair as described above wherein the seat and back can be unlatched from the more inclined position so that when the patient leans forward to shift his center of gravity, the seat and back will return to a less inclined position with the aid of the springs and will be latched in said less inclined position so that the patient can leave the chair as he would from a normal type chair.

A still further object of the present invention is to provide a chair as described in the immediately preceding paragraph which also has a foot rest which can be extended from a remote position and can also be retracted from a remote position. Other objects and attendant advantages of the present invention will readily be perceived hereafter.

The present invention relates to a chair comprising a frame, a seat, a front portion on said seat pivotally mounted on said frame, a rear portion on said seat, a back mounted relative to said rear portion of said seat, a spring construction effectively positioned between said seat and said frame, a first selectively actuatable latch positioned between said seat and said frame effective to maintain said seat latched in a less inclined position on said frame, and a second selectively actuatable latch positioned between said seat and said frame effective to maintain said seat latched in a more inclined position on said frame against the bias of said spring construction.

The chair of the present invention as set forth in the immediately preceding paragraph also includes a foot rest pivotally mounted on said frame and movable between retracted and extended positions, and a cable secured to said foot rest for selectively retracting said foot rest to said retracted position.

The various aspects of the present invention will be more fully understood when the following portions of the specification are read in conjunction with the accompanying drawings wherein:

BRIEF DESCRIPTION OF THE SEVERAL VIEWS OF THE DRAWING

FIG. 9 is a fragmentary view taken substantially in the direction of arrows 9—9 of FIG. 7;

FIG. 10 is a fragmentary cross sectional view taken substantially along line 10—10 of FIG. 9;

FIG. 11 is a fragmentary view similar to FIG. 9 but taken substantially in the direction of arrows 11—11 of FIG. 8;

FIG. 11A is a fragmentary enlarged view of the slam latch of FIG. 11 in an open position;

FIG. 11B is a fragmentary view of the slam latch of FIG. 11 in a closed position;

FIG. 16 is a fragmentary partially broken away side elevational view taken in the direction of arrows 16—16 of FIG. 16 showing the foot rest in a retracted position;

DETAILED DESCRIPTION OF THE INVENTION

Figure 1:
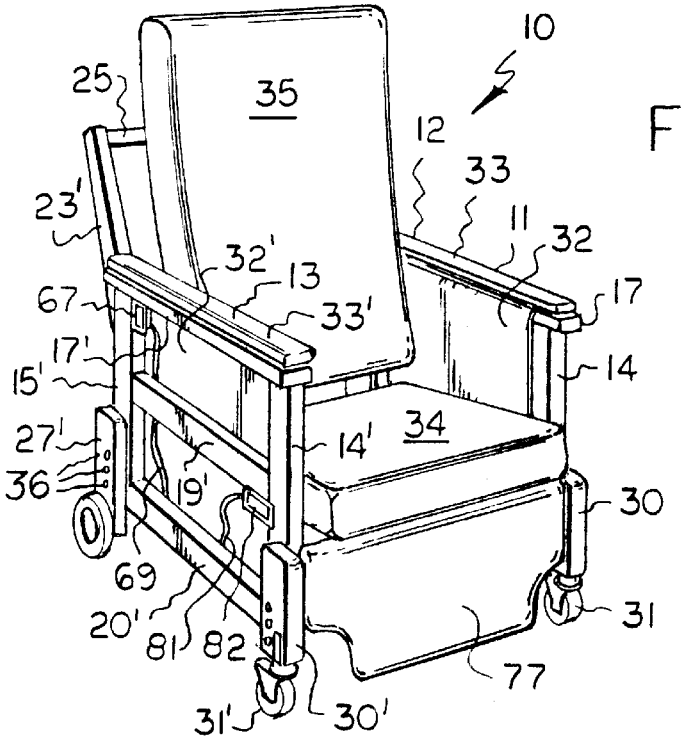
FIG. 1 is a perspective view of the chair of the present invention.

Summarizing briefly in advance, because of the structure which is to be described hereafter, a patient can enter the chair 10 of the present invention wherein the seat and back are positively latched in a less inclined position and wherein the seat and back can be unlatched from their less inclined positions whereby the center of gravity of the patient in the chair will cause it to tilt rearwardly to a more inclined position against the bias of springs and then be automatically latched in the more inclined position from which a patient cannot leave the chair. When it is desired to have the patient leave the chair, the seat and back are unlatched from the more inclined position and the patient, by merely tilting forward, will shift his center of gravity so that the seat and back return to their less inclined positions and are automatically latched therein so that the patient can leave the chair.

The spring biased tiltable chair 10 of the present invention includes a frame 11 having sides 12 and 13 which are mirror images of each other. Side 12 includes vertical members 14 and 15 which are connected across their tops by member 17 and across their midpoints by member 19 and across their lower ends by member 20. The connections are by screws (not shown). Side 13 consists of parts which are designated by primed numerals and such primed numerals represent the mirror image counterparts of the parts of side 12 which are represented by unprimed numerals. Therefore the parts represented by primed numerals will not be described in detail.

Figure 6:
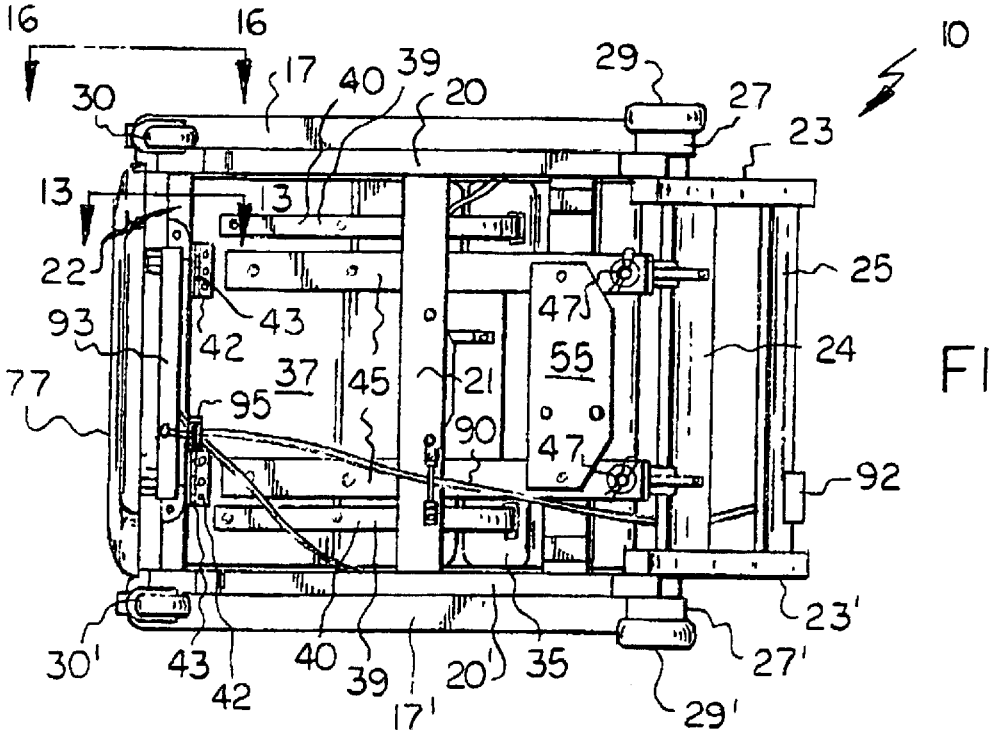
FIG. 6 is a bottom view of the chair taken substantially in the direction of arrows 6—6 of FIG. 2.

Cross member 21 (FIG. 6) is secured as by screws between frame members 20 and 20' of sides 12 and 13, respectively. Another cross member 22 (FIGS. 6, 7 and 8) extends between frame members 14 and 14' and is suitably secured thereto by screws. Mirror image arms 23 and 23' have their lower ends secured by nuts and bolts to frame members 15 and 15', respectively. A cross member 24 has its opposite ends secured to the central portions of arms 23 and 23' by screws. A cross member 25 had its opposite ends secured to the upper portions of arms 23 and 23' by screws. Blocks 27 and 27' are secured to the lower portions of frame members 15 and 15', respectively, by screws, and wheels 29 and 29' are suitably mounted on blocks 27 and 27', respectively. Blocks 30 and 30' are mounted on the lower portions of frame members 15 and 15', respectively, and pivotable wheels 31 and 31' are mounted on blocks 30 and 30', respectively. Blocks 27, 27', 30 and 30' are adjustably mounted on the frame so that the elevation of the seat can be adjusted by aligning different sets of holes between the blocks and the frame and passing bolts therethrough. In this respect, three bolts 36 mount each of blocks 27, 27', 30 and 30' on the frame and they selectively extend through at least two of four vertically spaced bolt-receiving holes in the frame members 14, 14', 15 and 15'. A sheet plastic panel 32 is suitably secured across frame members 17 and 20 in a vertical direction and across frame members 14 and 15 in a horizontal direction. A mirror image counterpart panel 32' extends across frame side 13. Padded arm rests 33 and 33' extend along the tops of frame members 17 and 17', respectively.

Figure 8A:
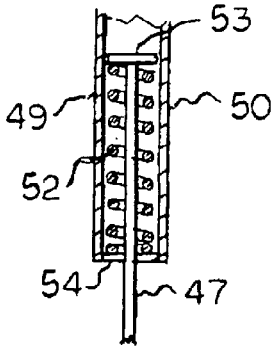
FIG. 8A is a fragmentary cross sectional view of the spring unit taken substantially along line 8A—8A of FIG. 8.
Figure 4:
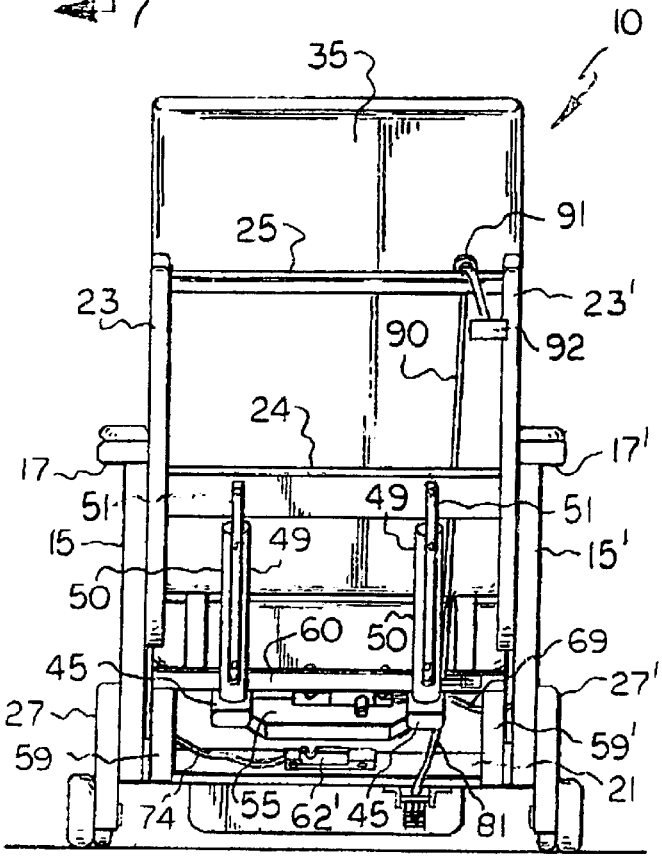
FIG. 4 is a rear elevational view of the chair.
Figure 5:
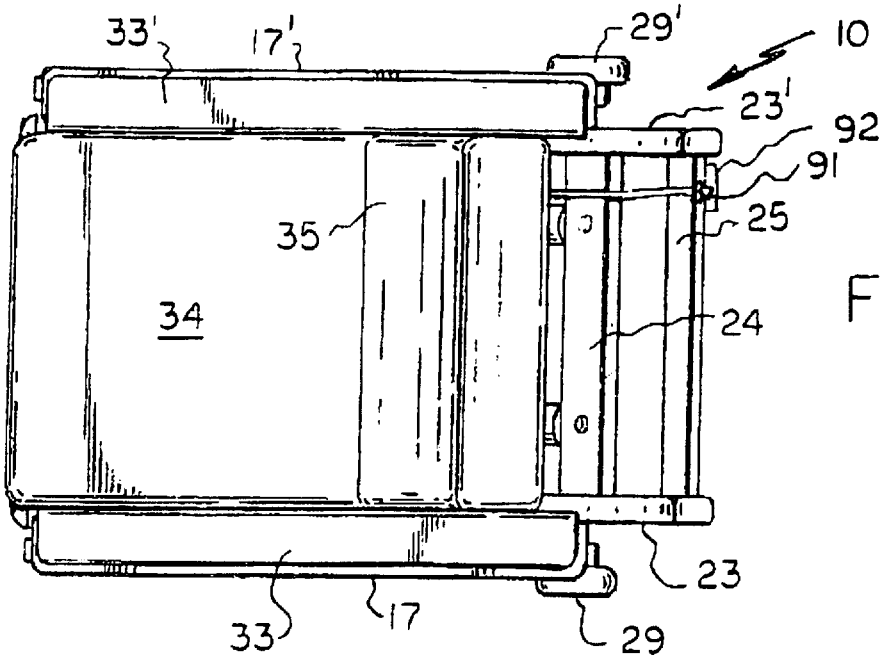
FIG. 5 is a top view of the chair taken substantially in the direction of arrows 5—5 of FIG. 2.
Figure 7:
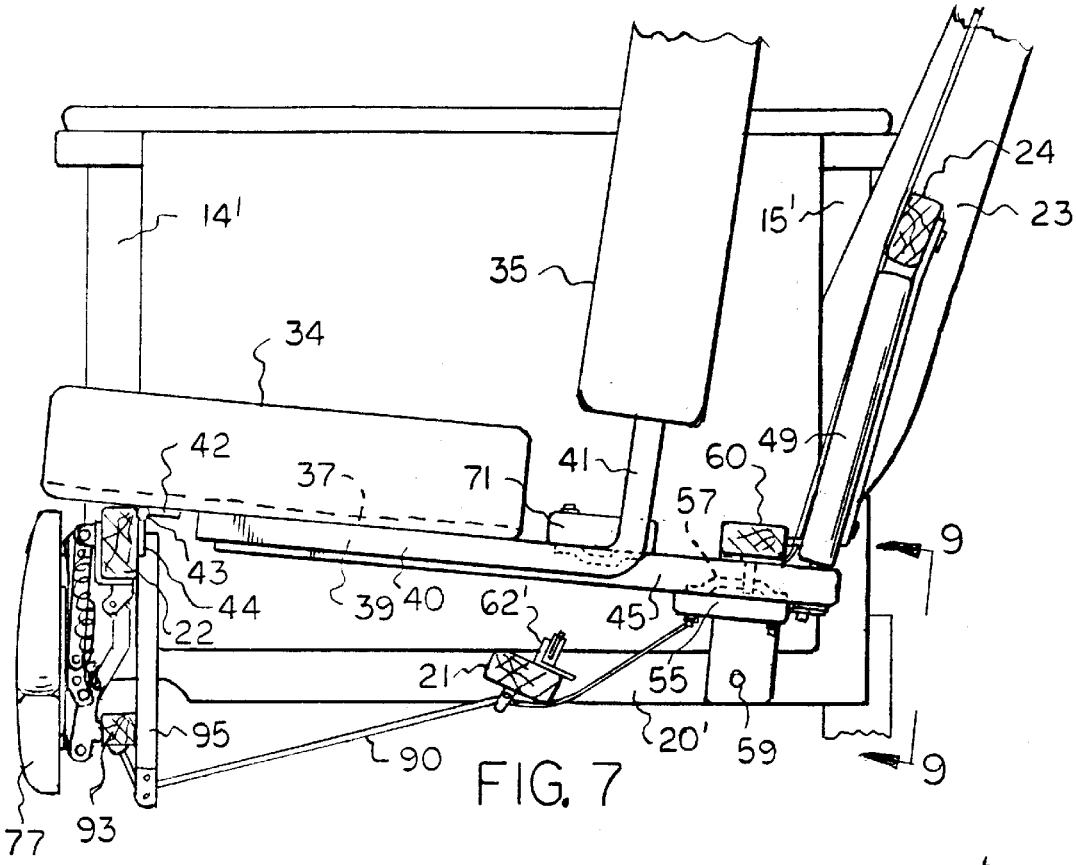
FIG. 7 is an enlarged fragmentary cross sectional view taken substantially along line 7—7 of FIG. 3 and showing the chair with its seat and its back in a less inclined position.
Figure 8:
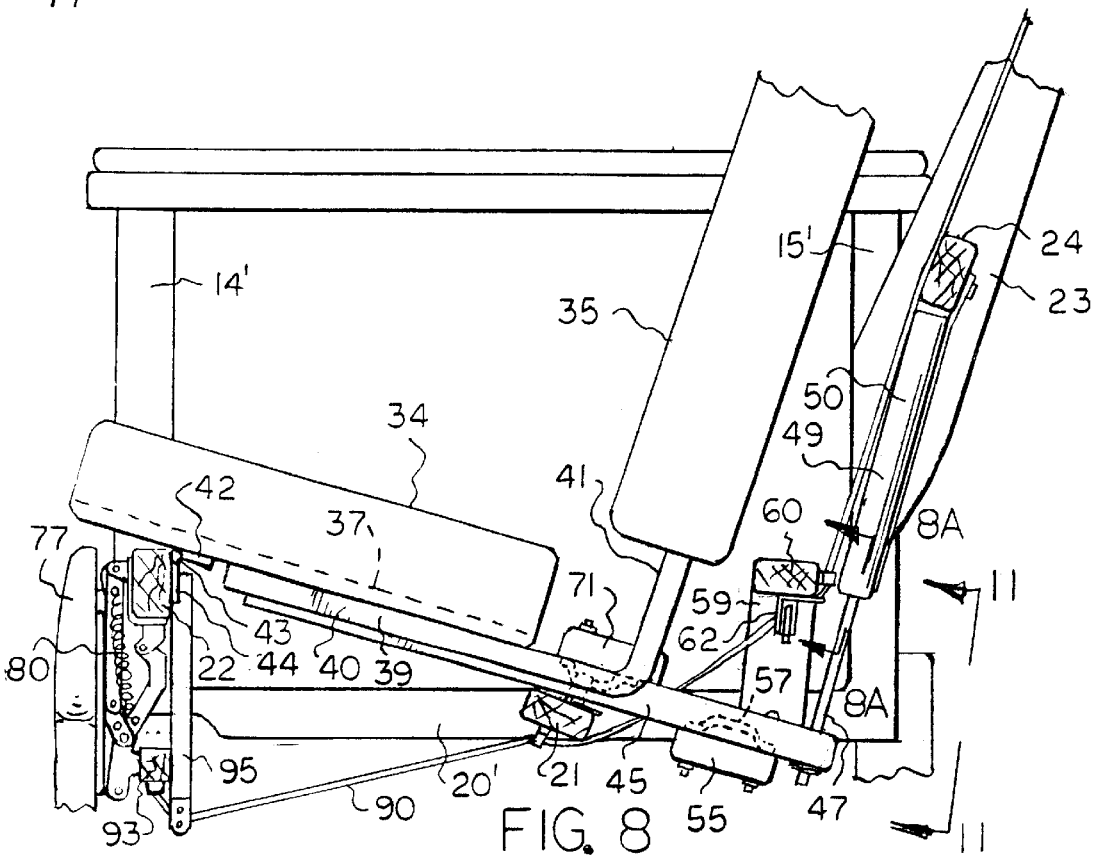
FIG. 8 is a view similar to FIG. 7 but showing the seat and the back in a more inclined position.
Figure 12:
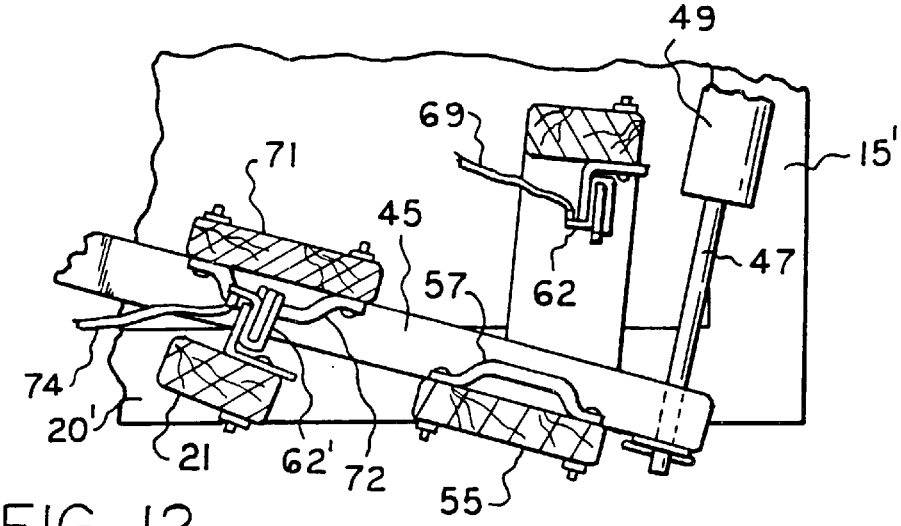
FIG. 12 is a fragmentary cross sectional view similar to FIG. 10 but taken substantially along line 12—12 of FIG. 11.

A combined seat 34 and back 35 is provided for movement in unison from the less inclined position of FIG. 7 to a rearwardly more inclined position of FIG. 8. In this respect, seat 34 includes a board 37 (FIGS. 6, 7 and 8) which extends across the entire bottom of the seat. L-shaped brackets 39 include substantially horizontal portions 40 which are bolted to board 37, and they include substantially vertical portions 41 which are received in and suitably secured to back 35. Board 37 of seat 34 is suitably secured to leaves 42 of hinges 43, the leaves 44 (FIGS. 7 and 8) of which are suitably secured to cross member 22. Thus, the combined seat 34 and back 35 can pivot about the axis of the pins of hinges 43 from the less inclined position of FIG. 7 to the more inclined position of FIG. 8 against the bias of spring units 49, 49 which extend between the frame and the combined seat and back. In this respect, two boards 45 (FIGS. 4, 6, 7 and 8) are firmly secured to board 37 of seat 34 and they extend rearwardly to a point where the rods 47 (FIG. 8) of spring units 49 are suitably secured thereto. Spring units 49 include outer casings 50 which are secured to frame cross member 24 by bands 51. Spring units 49 each include a spring 52 (FIG. 8A) which encircles rod 47 and is located between rod head 53 and casing end 54. Thus, when the combined seat and back unit is moved from the less inclined position of FIG. 7 to the more inclined position of FIG. 8, springs 52 will be stressed, and more specifically compressed, because such movement is against the bias of the springs. Conversely, when the combined seat and back unit moves from the more inclined position of FIG. 8 to the less inclined position of FIG. 7, springs 52 will tend to expand to aid in such movement.

Structure is provided for latching the combined seat and back unit in either the less inclined position of FIG. 7 or the more inclined position of FIG. 8. This structure is known as a "slam latch" or "rotary latch" structure. In this respect, a cross member 55 (FIGS. 4, 6, 7, 8, 9, 10, 11 and 12) has its opposite ends secured by screws to boards 45. An inverted U-shaped member 57 has its opposite ends bolted to the top of cross member 55 (FIGS. 7, 8, 10 and 11). Struts 59 and 59' (FIGS. 4 and 11) have their lower ends secured to frame members 20 and 20', respectively. A cross member 60 has its opposite ends secured to the tops of struts 59 and 59' (FIG. 9). Cross member 60 is positioned at a higher elevation than across member 21 (FIGS. 7 and 8). A slam latch 62 (FIG. 11) includes a frame 61 and a two-position latching member 62 which occupies the unlocked position of FIG. 11A or the locked position of FIG. 11B. The slam latch 62 is a commercially obtainable product sold under the trademark EBERHARD, and the specific model is identified by number 240/241. The slam latch is disclosed in U.S. Pat. Nos. 5,439,260, 5,564,295 and 5,884,948 which are incorporated herein by reference. The combination of latch member 57 and slam latch 62 is considered a slam latch structure. Frame 61 is mounted on the underside of cross member 60. The slam latch 62 includes a forked latch 63 having spaced legs 65 which is pivotally mounted at 64 on slam latch 62. Thus, inverted U-shaped latch member 57 (FIG. 11) can move up and enter the space between forked legs 65, and when it does so, forked member 63 will move from the unlatched position of FIG. 11A to the latched position of FIG. 11B. Thus, the combined seat and back will be latched in its less inclined position of FIG. 7 with the seat 34 more horizontal and the back 35 more vertical. This less inclined position of the seat is the position which receives a patient who is being seated, and this is the position when the patient leaves the chair. Since the seat and back are latched in the position of FIG. 7, the patient can lean back in the chair without the seat and back tilting to the position of FIG. 8. Thus, a patient can enter and leave the chair as he would from a conventional chair.

Figure 21:
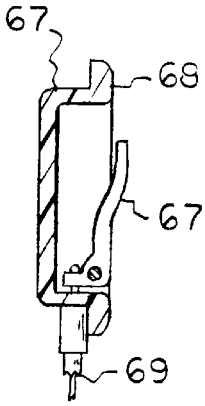
FIG. 21 is a cross sectional view taken substantially along line 21—21 of FIG. 20 and showing the lever in a dormant position.
Figure 22:
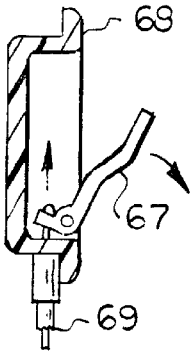
FIG. 22 is a cross sectional view similar to FIG. 21 but showing the lever in an actuating position.

After a patient has been seated while the combined seat and back are latched in the less inclined position of FIG. 7, it is desired to have the combined seat and back to move to the more inclined position of FIG. 8 from which the patient cannot leave the chair because it is tilted too far rearwardly. This is achieved by unlatching inverted U-shaped latch member 57 from the slam latch 62. To this end a cable structure is provided. One end of the cable 69 is secured to lever 67 (FIGS. 1, 20, 21 and 22) which is accessible to a nursing home attendant, but is relatively inaccessible to a patient who is seated in the chair. Lever 67 is pivotally mounted on its housing 68 and is biased by a spring (not shown) to a dormant or non-actuating position so that after it has been moved to its actuating position of FIG. 22 and released, it will return to its dormant position of FIG. 21. The cable 69 extends along side 32' and below side 32' and is received at slam latch 62 (FIGS. 9 and 10) so that manipulation of lever 67 can release inverted U-shaped member 57 from slam latch 62 so that the latch member 63 will go from the position of FIG. 11B, wherein the seat 34 is latched in the less inclined position, to the position of FIG. 11A wherein the seat 34 is unlatched from its less inclined position. Thus, when a patient is sitting on seat 34 after the latch has been unlatched, his center of gravity is such that the combined seat and back unit will pivot about the pins of hinges 44 and will move from the less inclined position of FIG. 7 to the position of FIG. 8 against the bias of springs 52 in spring units 49.

A slam latch 62' (FIGS. 4 and 10) is provided for retaining the combined seat and back unit latched in the more inclined position of FIG. 8 from which an untied patient is tilted sufficiently rearwardly so that he cannot leave the chair. In this respect, a cross member 21 (FIG. 9) has its opposite ends secured to frame members 20 and 20'. A slam latch 62' includes a frame 61' which is mounted on cross member 21. A cross member 71 (FIG. 11) extends across boards 45 and it has its opposite ends secured thereto. An inverted U-shaped latch member 72 (FIG. 10) has its opposite ends secured to cross member 71. Thus, when the seat moves to the more inclined position of FIG. 8, inverted U-shaped latch member 72 will be received in slam latch 62' which moves from a position which is analogous to the position shown in FIG. 11A to a latched position which is analogous to the position shown in FIG. 11B to thereby positively latch the seat and back in the more inclined position of FIG. 8. The combination of latch member 72 and slam latch 62' is considered a slam latch structure.

Figure 2:
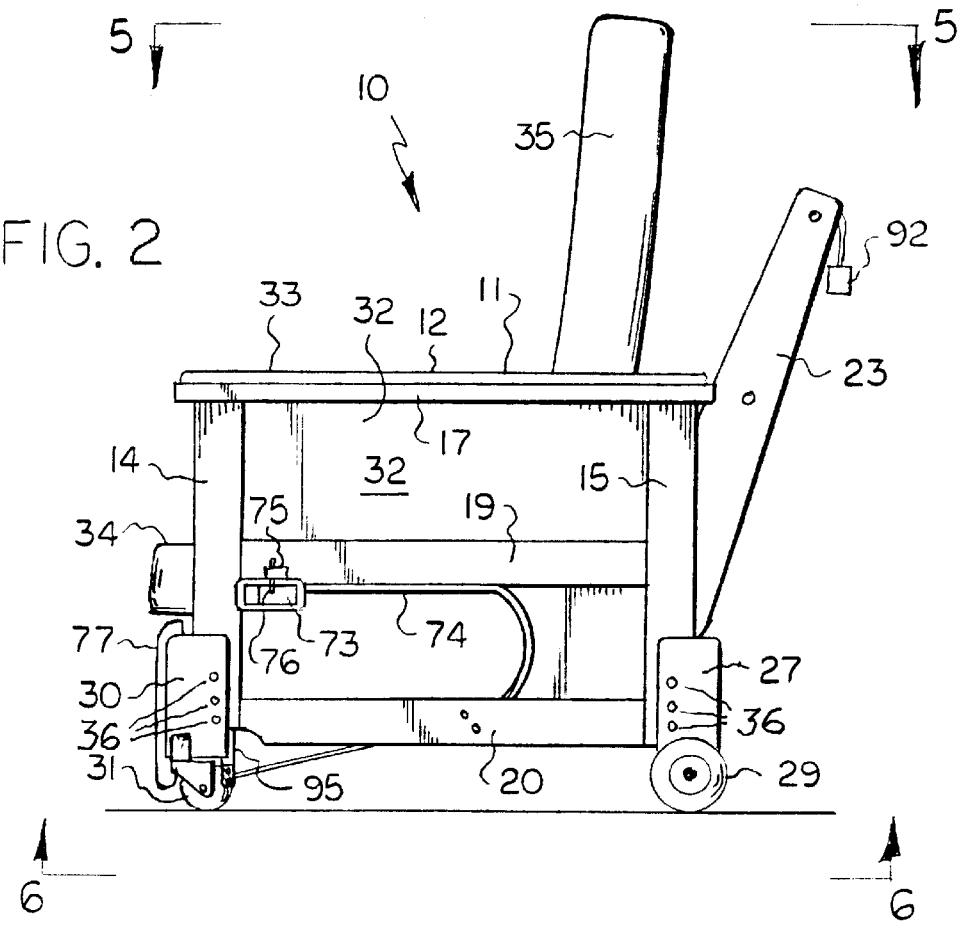
FIG. 2 is a side elevational view of the left side of the chair.
Figure 3:
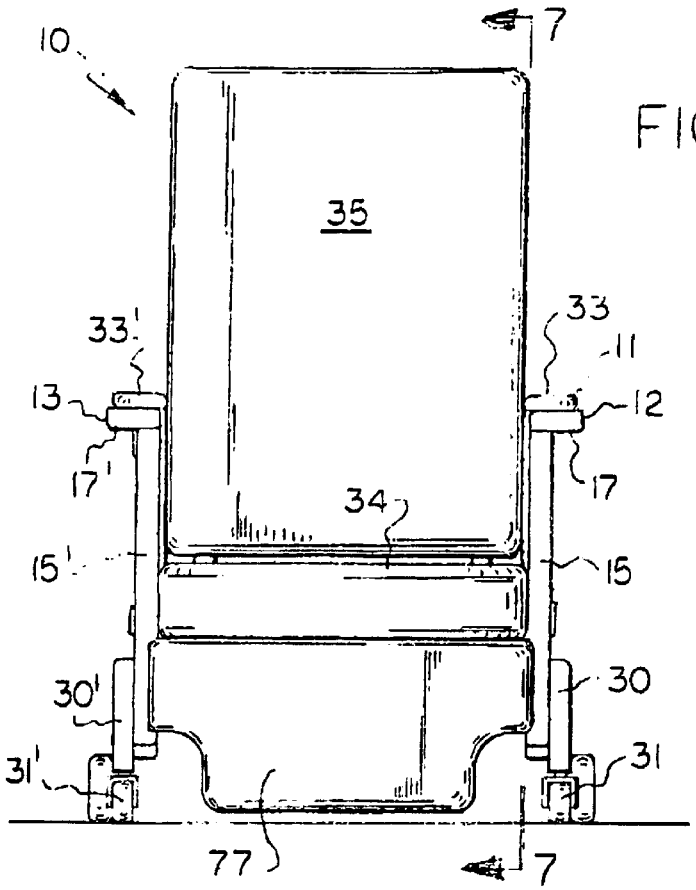
FIG. 3 is a front elevational view of the chair.
Figure 23:
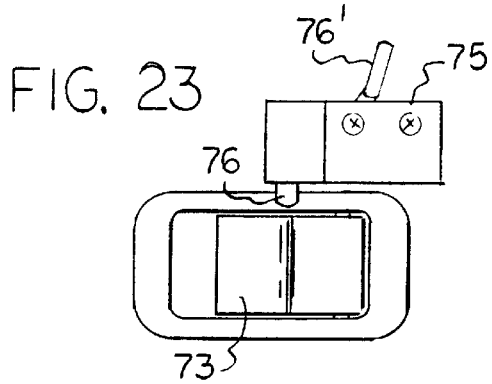
FIG. 23 is a front elevational view of the lever attached to a cable for unlatching the seat from its more inclined position and also showing a blocking structure for blocking the actuation of the lever with the last-mentioned structure being in an unblocking position.
Figure 24:
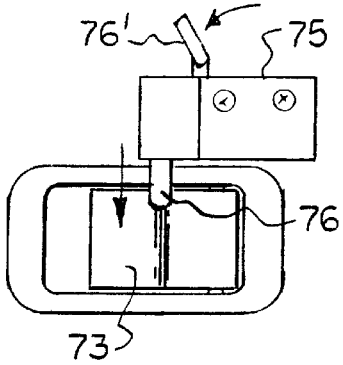
FIG. 24 is a view similar to FIG. 23 but showing the blocking structure in a blocking position.

A cable structure is provided to release slam latch 62' so that the combined back and seat can move from the more inclined position of FIG. 8 to the less inclined position of FIG. 7. In this respect, a lever 73 (FIGS. 2, 23 and 24) is mounted on frame member 19, and a cable 74 extends along side 32 and below side 32 and is received by slam latch 62' (FIG. 9). Lever 73 is of the same construction as lever 67 which was described relative to FIGS. 20 and 22. In this respect, it is normally dormant, and after it has been actuated against the bias of a spring and released, it will return to a dormant, non-actuated position. Thus, when lever 73 is actuated, slam latch 62' will open to the position analogous to that shown in FIG. 11A, and as the patient leans forward, his center of gravity will shift so that the combined seat and back will pivot in a counterclockwise direction in FIG. 8 about the pin of hinges 44, and this movement is assisted by the expansion of springs 52 in spring units 49. The counterclockwise movement will continue until U-shaped member 57 engages slam latch 62 whereupon the combined seat and back will again be positively latched in the less inclined position of FIG. 7 from which the patient can leave the chair. A lock arrangement 75 (FIGS. 2, 23 and 24) is mounted proximate to lever 73 so that lever 73 can be locked against movement to a position wherein it unlatches latch 62'. The lock arrangement includes a pin 76 which can be moved into overlying relationship with lever 73 by manipulating lever 76' so that it cannot be actuated.

Figure 13:
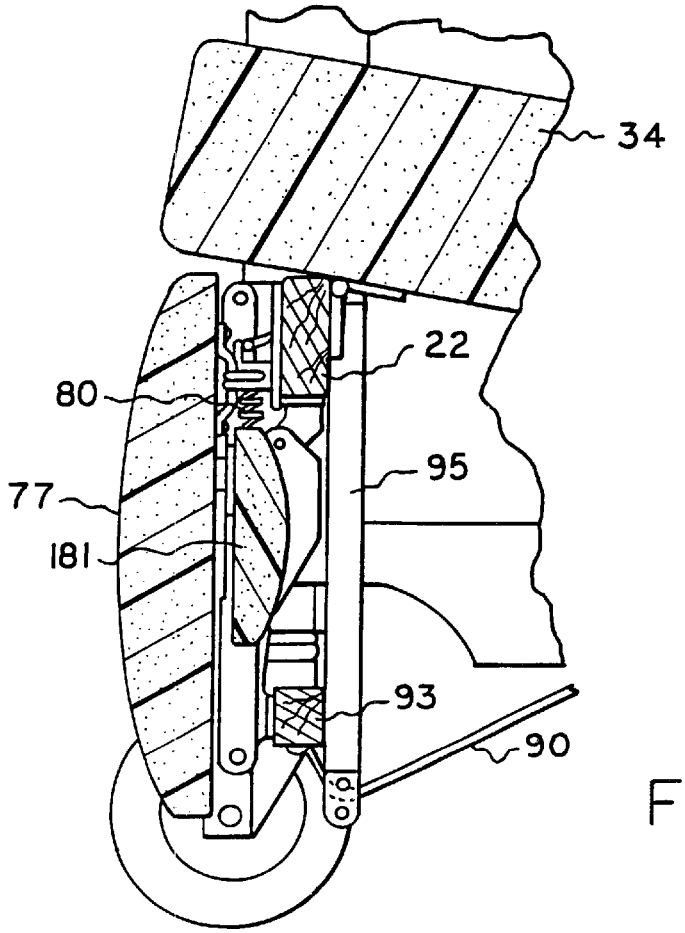
FIG. 13 is an enlarged fragmentary cross sectional view taken substantially along line 13—13 of FIG. 6 and showing the foot rest in a retracted position.
Figure 14:
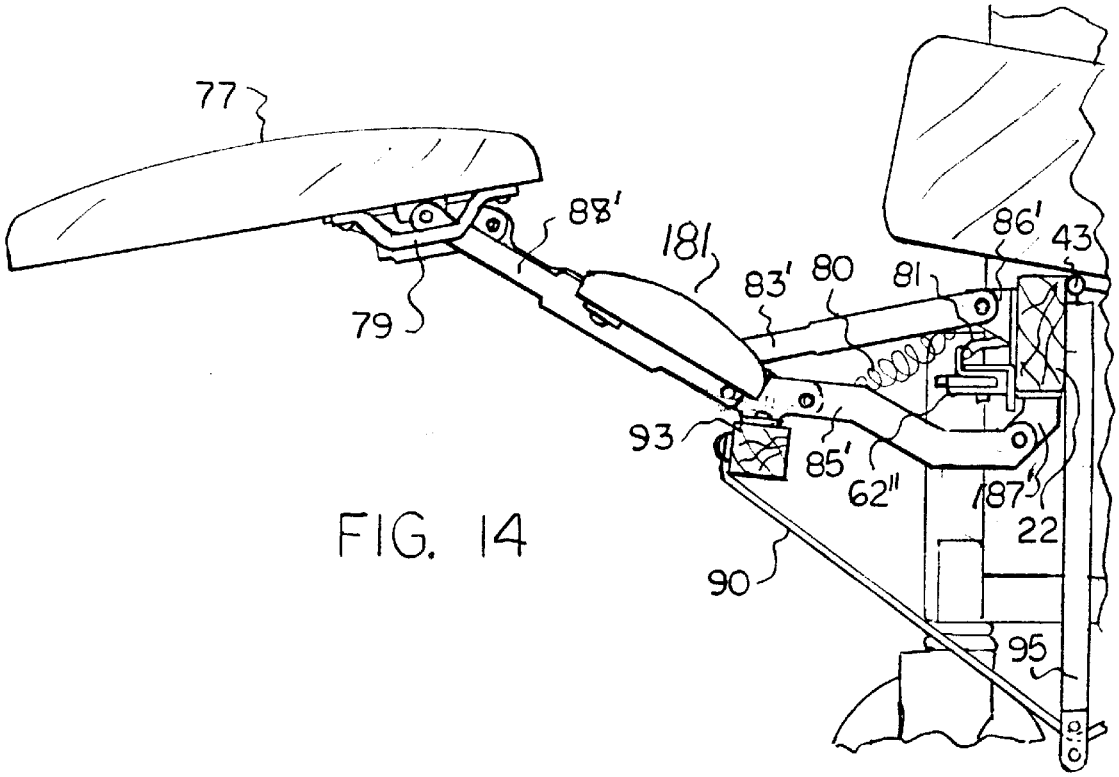
FIG. 14 is a view similar to FIG. 13 but showing the foot rest in an extended position.
Figure 15:
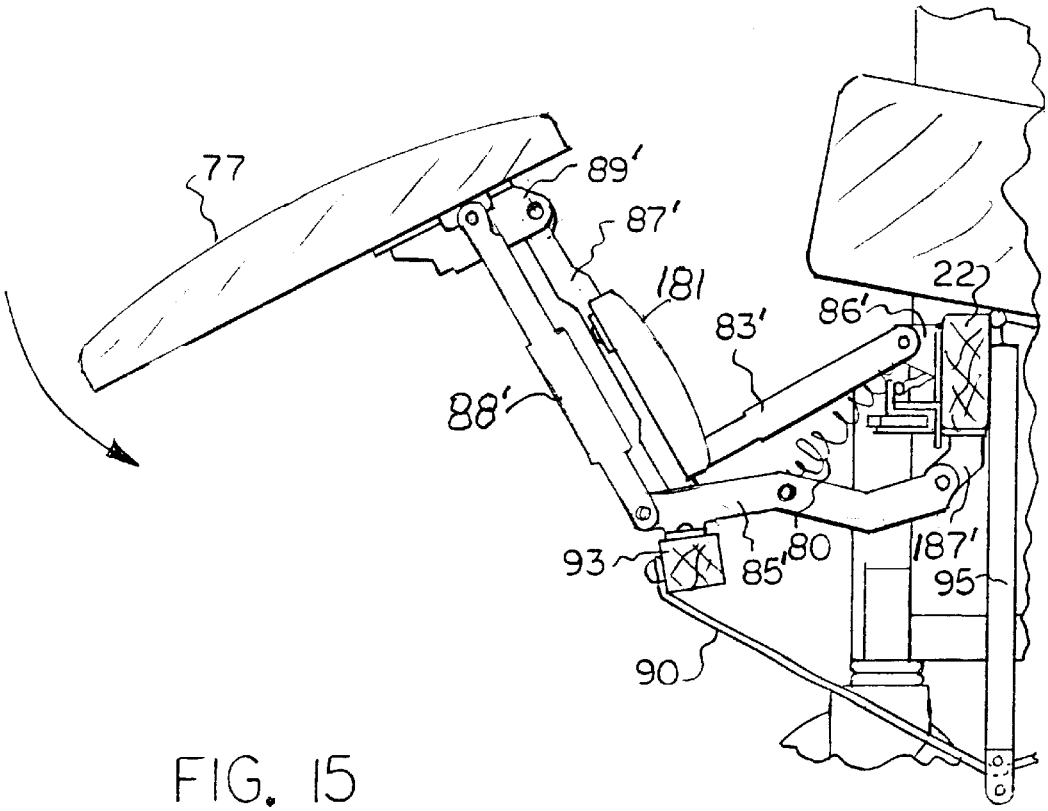
FIG. 15 is a view similar to FIGS. 13 and 14 but showing the foot rest and its linkage in an intermediate position as it is being retracted to its retracted position.
Figure 17:
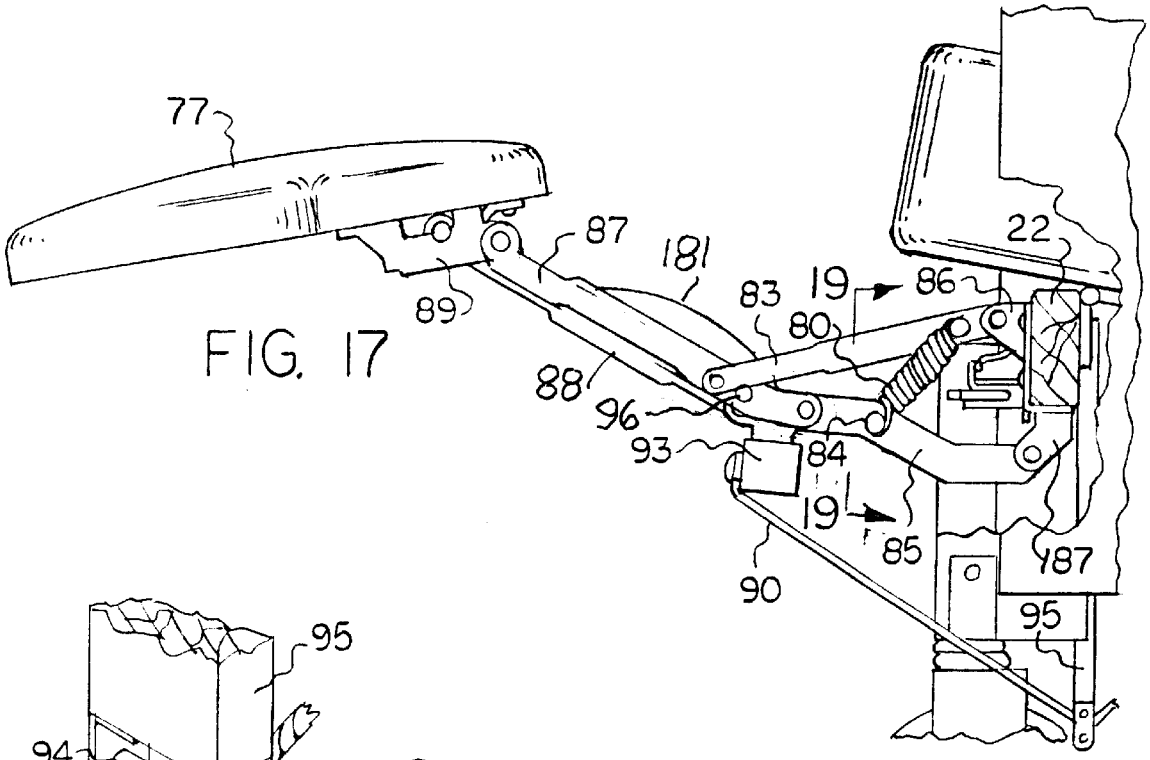
FIG. 17 is a fragmentary partially broken away view of the linkage shown in FIG. 16 with the foot rest in an extended position.
Figure 19A:
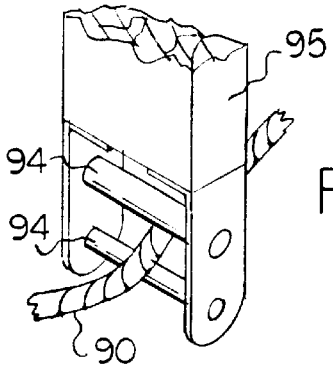
FIG. 19A is a fragmentary perspective view of the guide for the cable which retracts the foot rest.
Figure 18:
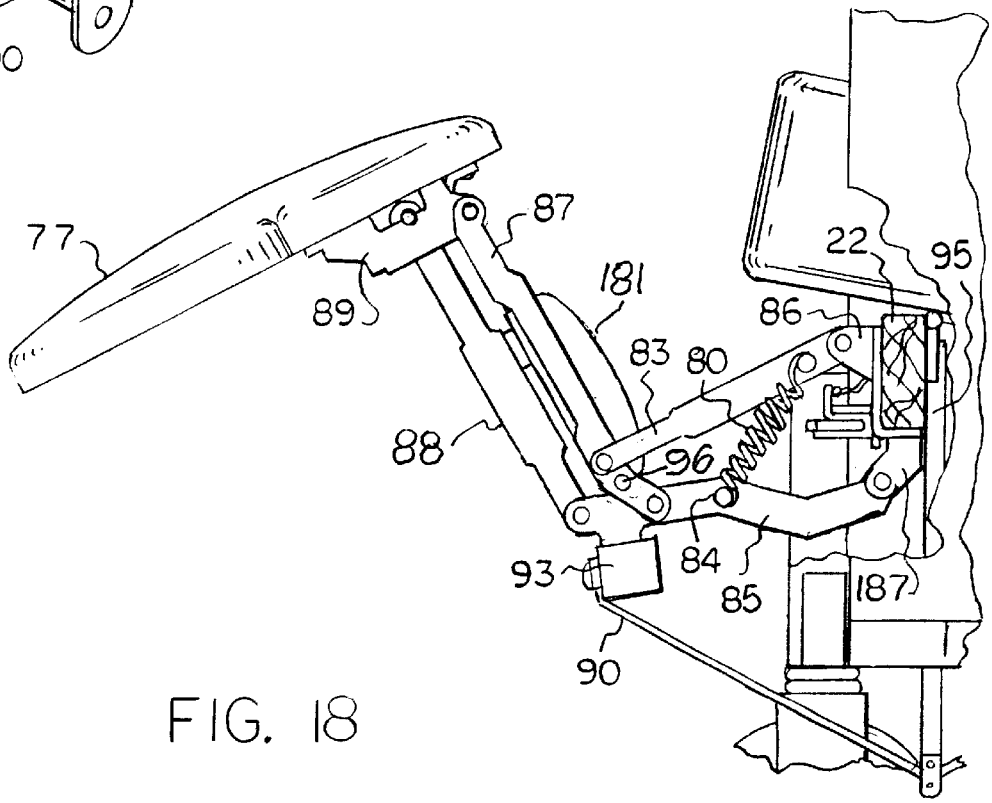
FIG. 18 is a fragmentary partially broken away view of the linkage of FIGS. 16 and 17 with the foot rest in an intermediate position.
Figure 19:
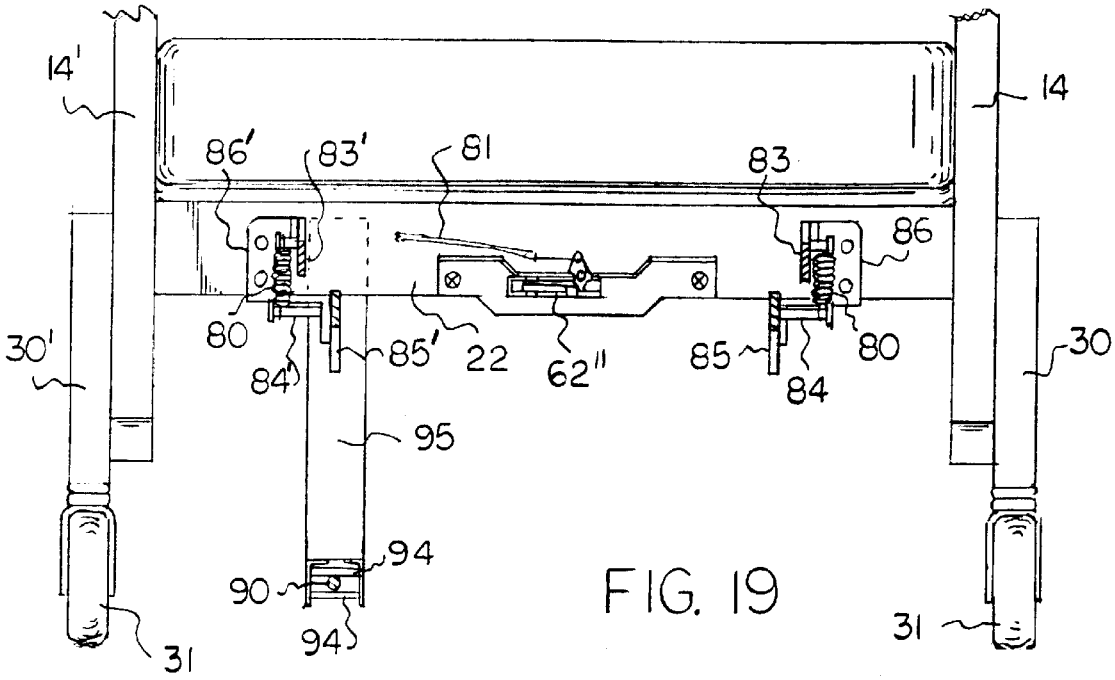
FIG. 19 is a fragmentary cross sectional view taken substantially along line 19—19 of FIG. 17.
Figure 20:
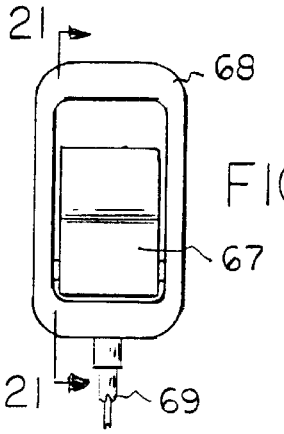
FIG. 20 is a front elevational view of the lever attached to a cable for unlatching the seat from its less inclined position.

A foot rest structure is also provided. Normally the foot rest 77 is in the retracted position of FIGS. 1, 3, 13 and 16 wherein U-shaped member 79 (FIG. 14) which is secured to the back of foot rest 77 is received in a slam latch 62" (FIG. 19) which is identical to slam latch 62 described above in FIGS. 8, 11, 11A and 11B. Latch 62" (FIG. 19) is mounted on cross member 22 on the opposite side thereof from hinge 43. When U-shaped member 79 (FIG. 14) is engaged with latch 62", springs 80 (FIGS. 13–19) are extended. Cable 81 (FIG. 1) has one end attached to lever 82 and its opposite end to latch 62". Lever 82 is identical to lever 67 described above relative to FIGS. 20–22. When lever 82 is actuated, latch 62" will open and springs 80 at opposite sides of the foot rest linkage will contract to move the foot rest 77 from the fully retracted position of FIGS. 13 and 16 to the fully extended position of FIGS. 14 and 17. In the fully extended position of FIG. 17, link 83 bears against pin 96 which extends outwardly from link 87. A corresponding pin extends outwardly from link 87'. First ends of springs 80 are secured to links 83 (FIG. 17) and second ends of spring 80 are secured to pins 84 (FIG. 19) which extend outwardly from links 85 which have first ends pivotally mounted on brackets 187 and 187' (FIGS. 14 and 18) which are secured to the underside of cross member 22 (FIG. 14). Links 83 have first ends mounted on brackets 86 (FIGS. 15 and 19) on cross member 22 and the opposite ends thereof are pivotally mounted on links 87 (FIG. 17) which have opposite ends mounted on brackets 89 on the rear side of foot rest 77. A link 88 extends between bracket 89 and the end of link 85. A padded bar 181 is secured by brackets (not shown) between links 87. It will be noted that one side of the foot rest linkage is shown in FIGS. 13–15, and the opposite side is shown in FIGS. 16–18. The links and brackets on the two sides of the foot rest linkage are mirror images of each other. The links and brackets on the side shown in FIGS. 16–18 are designated with unprimed numerals and corresponding links and brackets shown in FIGS. 14, 15 and 19 are designated with the same numerals which are primed.

A cable arrangement is provided to retract foot rest 77 from its fully extended position of FIGS. 14 and 17 to its fully retracted position of FIGS. 13 and 16. In this respect, a cable 90 has one end attached to bar 93 (FIGS. 6, 14 and 18) which is secured across spaced links 85. This cable passes between rollers 94 (FIGS. 19 and 19A) which are located at the lower end of vertical member 95 having its upper end bolted to cross member 22. Cable 90 thereafter passes underneath cross member 21 (FIG. 6) and across the rear of cross member 60 (FIG. 8) and through loop 91 on the top of cross member 25 and it terminates at handle 92 which is pulled, to thereby return foot rest 77 to its stored position wherein U-member 79 (FIG. 14) is retained in slam latch 62". The above described foot rest linkage is well known commercially, but it has been adapted to the above-described usage wherein it can be retracted to a stored latched condition by a cable arrangement having a handle at the rear of the chair. The foot rest linkage is a product of the Supersagless Division of Leggett and Platt and is known by Model No. 123DLR1961.

While a preferred embodiment of the present invention has been disclosed, it will be appreciated that it is not limited thereto but may be otherwise embodied within the scope of the following claims.

What is claimed is:

1. A chair comprising a frame, a seat, a front portion on said seat pivotally mounted on said frame, a rear portion on said seat, a back mounted relative to said rear portion of said seat, a spring construction effectively positioned between said seat and said frame, a first selectively actuatable latch positioned between said seat and said frame effective to maintain said seat latched in a less inclined position on said frame, and a second selectively actuatable latch positioned between said seat and said frame effective to maintain said seat latched in a more inclined position on said frame against the bias of said spring construction, said first and second latches being slam latches.

2. A chair as set forth in claim 1 wherein said back is mounted in fixed relationship to said seat.

3. A chair as set forth in claim 1 including spaced arms on said frame located on the opposite side of said back from said seat, said spaced arms extending in generally the same direction as said back and being spaced therefrom.

4. A chair as set forth in claim 1 including a plurality of floor-engaging wheels mounted on said frame.

5. A chair as set forth in claim 4 including a cross member extending across said spaced arms.

6. A chair as set forth in claim 1 including a foot rest pivotally mounted on said frame and movable between retracted and extended positions, and a cable secured to said foot rest for selectively retracting said foot rest to said retracted position.

7. A chair as set forth in claim 6 including a slam latch mounted on said frame for retaining said foot rest in said retracted position.

8. A chair as set forth in claim 7 including a cable coupled to said slam latch for opening said slam latch.

9. A chair comprising a frame, first and second sides on said frame, a seat having a front portion and a rear portion, a back mounted relative to said rear portion of said seat, a first slam latch structure mounted for latching engagement at a first elevation between said seat and said frame, and a second slam latch structure mounted for latching engagement at a second elevation between said seat and said frame.

10. A chair as set forth in claim 9 wherein said front portion of said seat is pivotally mounted on said frame, and wherein said first elevation is higher on said frame than said second elevation.

11. A chair as set forth in claim 10 including a first cable coupled relative to said first slam latch structure for selective unlatching thereof, and a second cable coupled to said second slam latch structure for selective unlatching thereof.

12. A chair as set forth in claim 10 including a spring structure effectively mounted between said seat and said frame, said spring structure being stressed when said latch structure is latched at said second elevation.

13. A chair as set forth in claim 12 including a first cable coupled relative to said first slam latch structure for selective unlatching thereof, and a second cable coupled to said second slam latch structure for selective unlatching thereof.

14. A chair as set forth in claim 9 wherein said frame includes a first cross member located at a first elevation between said first and second sides of said frame and a second cross member located at a second elevation between said first and second sides of said frame with said first elevation being higher than said second elevation, and wherein said first slam latch structure is mounted between said seat and said first cross member, and said second slam latch structure is mounted between said seat and said second cross member.

15. A chair as set forth in claim 9 including an extendible and retractable foot rest on said chair.

16. A chair as set forth in claim 15 including a third slam latch on said chair for retaining said foot rest in a retracted position.

* * * * *